US006957744B2

(12) United States Patent
Holley, Jr.

(10) Patent No.: US 6,957,744 B2
(45) Date of Patent: Oct. 25, 2005

(54) NIPPLE WITH MULTIPLE PINHOLES FOR BABY BOTTLE ASSEMBLY

(75) Inventor: James W. Holley, Jr., Colorado Springs, CO (US)

(73) Assignee: Insta-Mix, Inc., Colorado Springs, CO (US)

( * ) Notice: Subject to any disclaimer, the term of this patent is extended or adjusted under 35 U.S.C. 154(b) by 0 days.

(21) Appl. No.: 10/351,137

(22) Filed: Jan. 24, 2003

(65) Prior Publication Data

US 2004/0144743 A1 Jul. 29, 2004

(51) Int. Cl.[7] ..... A61J 11/02; A61J 9/04; A61J 11/00; A61J 9/00

(52) U.S. Cl. ..... 215/11.1; 215/11.4

(58) Field of Search ..... 215/11.1, 11.4, 215/11.5; 220/711, 714

(56) References Cited

U.S. PATENT DOCUMENTS

| | | | | | |
|---|---|---|---|---|---|
| 156,549 | A | * | 11/1874 | Dickinson | 215/11.1 |
| 1,683,246 | A | * | 9/1928 | Griffiths | 215/11.1 |
| 2,588,069 | A | * | 3/1952 | Allen | 215/11.1 |
| 2,630,118 | A | | 3/1953 | Casey | |
| 2,630,932 | A | * | 3/1953 | Lestakis | 215/11.1 |
| 2,708,421 | A | | 5/1955 | Jauch | |
| 2,889,829 | A | * | 6/1959 | Tannenbaum et al | 606/236 |
| 3,047,950 | A | * | 8/1962 | Stasiuk | 30/368 |
| 3,086,549 | A | | 4/1963 | Fino | |
| 3,217,574 | A | | 11/1965 | Nauta et al. | |
| 3,532,242 | A | * | 10/1970 | Tibbs | 215/11.1 |
| 4,676,386 | A | * | 6/1987 | Phlaphongphanich | 215/11.1 |
| 4,765,497 | A | | 8/1988 | Hsu | |
| 4,928,836 | A | | 5/1990 | Wu et al. | |
| 4,993,568 | A | | 2/1991 | Morifuji et al. | |
| 5,071,017 | A | | 12/1991 | Stull | |
| 5,101,991 | A | | 4/1992 | Morifuji et al. | |
| 5,186,347 | A | | 2/1993 | Freeman et al. | |
| 5,300,089 | A | * | 4/1994 | Sassin | 606/236 |
| 5,410,814 | A | * | 5/1995 | Caban | 30/368 |
| 5,499,729 | A | | 3/1996 | Greenwood et al. | |
| 5,542,670 | A | | 8/1996 | Morano | |
| 6,042,850 | A | * | 3/2000 | Ida et al. | 426/2 |
| 6,053,342 | A | | 4/2000 | Chomik | |
| 6,161,710 | A | * | 12/2000 | Dieringer et al. | 215/11.4 |
| 6,253,935 | B1 | * | 7/2001 | Fletcher | 215/11.1 |
| 6,343,704 | B1 | * | 2/2002 | Prentiss | 215/11.1 |
| 6,588,613 | B1 | * | 7/2003 | Pechenik et al. | 215/11.1 |
| 2002/0063103 | A1 | * | 5/2002 | Kiernan | |

FOREIGN PATENT DOCUMENTS

| | | | | |
|---|---|---|---|---|
| FR | 571788 | * | 5/1924 | 215/11.1 |
| FR | 2302724 | * | 10/1976 | 215/11.1 |
| GB | 2154451 A | * | 9/1985 | 215/11.4 |
| WO | WO 9203118 A1 | * | 3/1992 | 215/11.1 |
| WO | WO 99/29278 | | 6/1999 | |
| WO | WO 03/045200 A2 | | 6/2003 | |

* cited by examiner

*Primary Examiner*—Sue A. Weaver
(74) *Attorney, Agent, or Firm*—Bever, Hoffman & Harms, LLP; Patrick T. Bever

(57) ABSTRACT

A baby bottle assembly including a nipple having a substantially flat membrane defining multiple pinholes for controlling the flow of liquid. The nipple is mounted on a cap that screws onto the bottle body. The nipple is formed from a suitable elastomeric material (e.g., soft rubber, thermoplastic elastomer, or silicone) such that the membrane stretches when subjected to a differential pressure. The pinholes are formed by puncturing the membrane while subjecting the membrane to radial tension, and using one or more pins having a substantially circular cross-section and sized such that each pinhole is closed by the surrounding elastomeric material when the pins are removed.

18 Claims, 2 Drawing Sheets

NIPPLE WITH MULTIPLE PINHOLES FOR BABY BOTTLE ASSEMBLY

FIELD OF THE INVENTION

The present invention relates to baby bottle assemblies, and more specifically it relates to nipples for baby bottle assemblies that exhibits adjustable flow characteristics.

RELATED ART

Natural breasts generally adjust to a baby's sucking power so that its nutritional needs are met as it grows. When newborn, an infant's sucking force is relatively weak and its appetite is relatively small, so the female breast supplies a relatively low flow rate. As the infant grows into a toddler, its sucking force increases along with its appetite. Female breasts are able to adjust to this increased demand by providing a higher flow rate in response to the increased sucking force and appetite.

Unlike breast-fed babies, bottle-fed babies often experience feeding related problems associated with conventional nipple products that exhibit substantially fixed milk flow rates. That is, many conventional nipples are provided with an opening that is sized to facilitate a relatively fixed amount of milk flow depending on the size of the baby. Nipples for newborn babies have relative small holes that support relatively low flow rates, while nipples for toddlers typically include relatively large holes or slits to facilitate greater flow rates. A problem arises when a baby's draw rate fails to match the particular nipple from which that baby is being fed. For example, when a newborn infant is fed from a toddler nipple, the high flow rate can result in choking and coughing. Conversely, when a toddler is presented with a newborn baby's nipple, the low flow rate can cause frustration. In many instances, parents experience a great deal of anxiety trying to match the correct nipple to a baby's ever-changing milk flow demand.

What is needed is a nipple for a baby bottle that automatically adjusts its flow rate to the needs of a growing baby, thereby allowing a single nipple to be used for both newborn infants and toddlers.

SUMMARY

The present invention is directed to a baby bottle assembly including a nipple having a substantially flat membrane defining multiple pinholes for controlling the flow of liquid. The nipple is formed from a suitable elastomeric material (e.g., soft rubber, thermoplastic elastomer, or silicone) such that the membrane stretches when subjected to a differential pressure. The pinholes are formed by puncturing the membrane while applying radial tension such that the membrane stretches at least 1% of its resting diameter. The puncturing process is performed using one or more pins having a substantially circular cross-section and sized such that each pinhole is closed by the surrounding elastomeric material when the radial tension is removed. According to an aspect of the present invention, during use the pinholes are opened by an amount determined by the amount of sucking force applied by the baby. For example, when a relatively small infant applies a relatively weak sucking force to the nipple, the membrane stretches a relatively small amount, and the pinholes open to a relatively small size, thereby resulting in a relatively low flow of liquid through the nipple. In contrast, when a relatively large toddler applies a relatively strong sucking force to the nipple, the membrane stretches a relatively large amount, and the pinholes open to a relatively large size, thereby resulting in a relatively large flow of liquid through the nipple. Accordingly, the present invention avoids the problems associated with conventional nipples by automatically adjusting the amount of flow according to the milk flow demand of the infant/toddler.

According to an embodiment of the present invention, the nipple includes a disk shaped flange, a lower conical wall section extending upward from the flange, a neck region located at an upper end of the lower conical wall section, and an upper conical wall section extending upward from the neck region. The disk-shaped membrane is formed on an upper portion of the upper conical wall section. The lower conical wall section defines a first diameter, the neck region defines a second diameter, and the membrane defines a third diameter, where the second diameter of the neck region is smaller than the first diameter of the lower conical wall section and the third diameter of the membrane. The flange and conical walls of the nipple are formed from relatively thick portions of elastomeric material (e.g., silicone, thermoplastic elastomer, or soft rubber), and the membrane is formed from a relatively thin section of the elastomeric material.

According to another embodiment of the present invention, the nipple includes a lower flange, a lower wall section extending upward from the flange, an oval neck structure extending from an upper end of the lower wall section, and an oval membrane formed at an upper edge of the upper wall section. As in the first embodiment, the flange and walls of the nipple are formed from relatively thick portions of elastomeric material (e.g., silicone, thermoplastic elastomer, or soft rubber), and the membrane is formed from a relatively thin section of the elastomeric material.

The present invention will be more fully understood in view of the following description and drawings.

DETAILED DESCRIPTION

Figure 1:
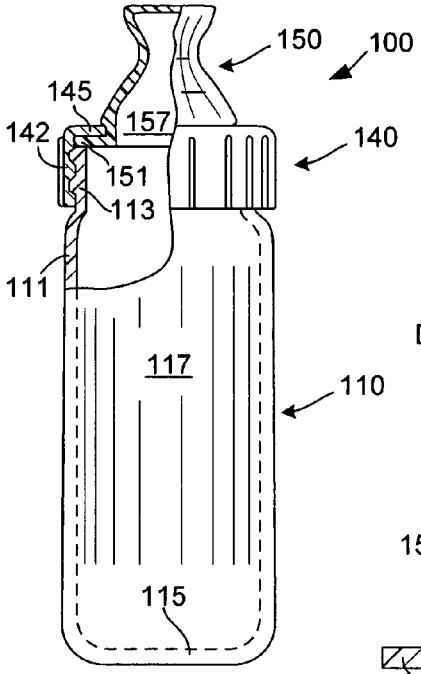
FIG. 1 is a partial cut-away side view showing a baby bottle assembly according to an embodiment of the present invention.

FIG. 1 is a partial cut-away side view showing a baby bottle assembly 100 according to an embodiment of the present invention. Baby bottle assembly 100 generally includes a substantially cylindrical bottle body 110, a ring-shaped cap 140, and an elastomeric flow control nipple 150 extending through an opening formed in cap 140.

Bottle body 110 is a standard baby bottle including a roughly cylindrical sidewall 111 having a threaded upper neck 113, and a bottom wall 115 located at a lower edge of sidewall 111. Sidewall 111 and bottom wall 115 define a beverage storage chamber 117 for storing a fluid beverage (i.e., infant formula or milk). Bottle body 110 is molded from a suitable plastic using known methods.

Cap 140 is also a substantially standard piece including a cylindrical base portion 142 having threaded inside surface, and a disk-shaped upper portion 145 defining a central opening through which a portion of nipple 150 extends. When cap 140 is connected (screwed) onto bottle body 110, the threads formed on cylindrical base portion 142 mate with threaded neck 113. Cap 140 is also molded from a suitable plastic using known methods.

Figure 2:
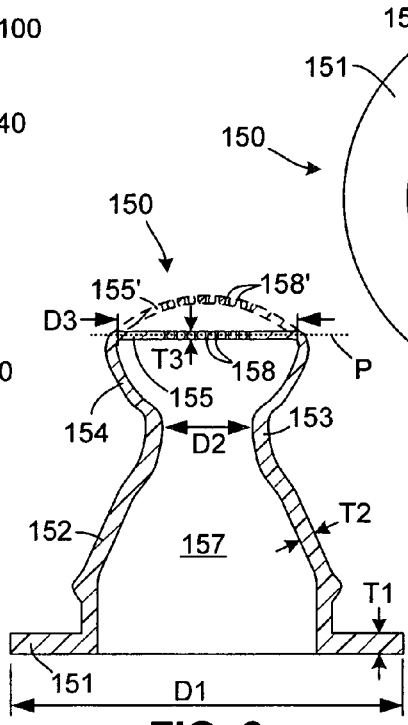
FIG. 2 is a cross-sectional side view showing a nipple according to an embodiment of the present invention.
Figure 3:
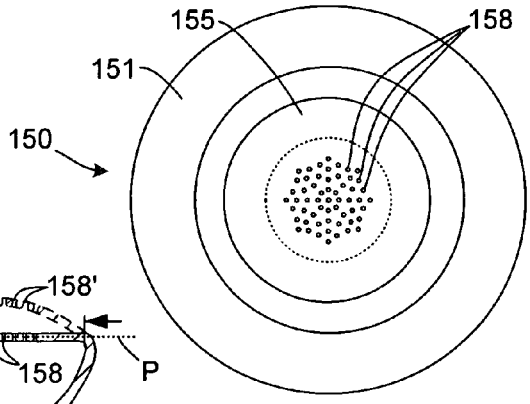
FIG. 3 is a top plan view of the nipple shown in FIG. 2.

Referring to FIGS. 2 and 3, nipple 150 is formed from a suitable elastomeric material (e.g., soft rubber, thermoplastic elastomer, or silicone) , and includes a lower disk-shaped flange 151, a lower conical wall section 152 extending upward from flange 151, a neck region 153 formed above lower conical wall section 152, an upper conical wall section 154 extending upward from neck region 153, and a substantially flat, disk-shaped upper membrane 155 located at the upper portion of upper conical wall section 154. Lower conical wall section 152, neck region 153, upper conical region 154, and membrane 155 define an interior chamber 157. As indicted in FIG. 1, when mounted in bottle assembly 100, a ring-shaped portion of flange 151 is pinched between an upper edge of neck 113 and a portion of upper portion 145 of cap 140, and interior chamber 157 of nipple 150 communicates with storage chamber 117 of bottle body 110. Lower conical wall section 152 extends through the opening defined in disk-shaped upper portion 145 of cap 140, and gradually tapers from a relatively wide diameter near flange 151 to a relatively narrow diameter D2 at neck region 153. Above neck region 153, upper conical wall section 154 again widens to a third, relatively wide diameter D3, which corresponds with the diameter of disk-shaped upper membrane 155. Flange 151 and conical sections 152 and 154 are formed using relatively thick sections of the elastomeric material, in comparison to membrane 155, which is relatively thin. In one embodiment, nipple 150 is molded as a single integral piece using silicone. In this embodiment, flange 151 has a thickness T1 in the range of 0.06 to 0.1 inches (e.g., approximately 0.1 inches) and a diameter D1 of approximately 2 inches, lower conical wall section 154 has a thickness T2 in the range of 0.04 to 0.08 inches (e.g., approximately 0.06 inches), and membrane 155 has a diameter D3 of approximately 0.75 inches and thickness T3 in the range of 0.01 to 0.1 inches (e.g., approximately 0.02 inches).

Figure 4A:
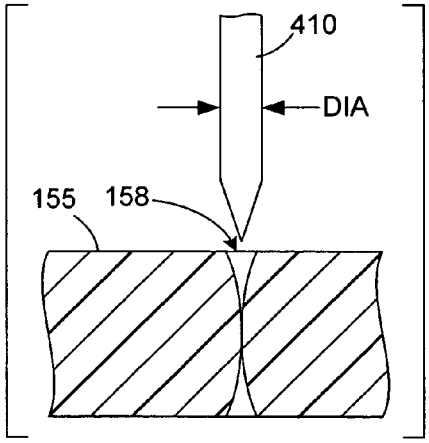
FIGS. 4(A), 4(B) and 4(C) are simplified enlarged cross-sectional views showing the formation and opening of a pinhole formed in the nipple of FIG. 2 during operation.

In accordance with the present invention, several pinholes 158 are formed in membrane 155 to facilitate adjustable liquid flow from storage chamber 117 through nipple 150. As indicated in FIG. 4(A), each pinhole 158 is formed by piercing membrane 155 with a pin 410, or other sharp pointed object, such that the pinhole is closed by the surrounding elastomeric material when pin 410 is subsequently removed. In a preferred embodiment, each pin 410 is formed with a continuously curved (e.g., circular) cross section such that each pinhole 158 is substantially circular (i.e., does not have a slit or fold that would be formed by a cutting element having an edge). Note that a pin having a diameter DIA of approximately 0.025 inches was used to produce successful pinholes in a membrane having a thickness of approximately 0.02 inches. In an alternative embodiment, a mold used to produce nipple 150 may include several pin-like structures that produce pinhole voids in molded elastomeric material, although this approach may result in continuously open holes. The number of pinholes 158 determines the amount of liquid flow through membrane 155 during use, as discussed below.

Referring again to FIG. 1, during operation nipple 150 is mounted onto cap 140 such that flange 151 is located against a lower surface of upper portion 145, and the remainder of nipple 150 extends through and is positioned above upper portion 145 of cap 140. A liquid (e.g., a beverage such as formula or milk) is then poured into storage chamber 117 of bottle body 110, and cap 140 is secured onto threaded upper neck 113. In this arrangement, while atmospheric equilibrium is maintained (i.e., the pressure inside bottle body 110 is equal to the pressure outside nipple 150), membrane 155 remains in the unstretched state illustrated in FIG. 4(A), wherein pinholes 158 remain closed to prevent leakage. As shown in FIG. 2, in one embodiment, the unstressed membrane 155 essentially entirely lies in (defines) a plane P.

Figure 4B:
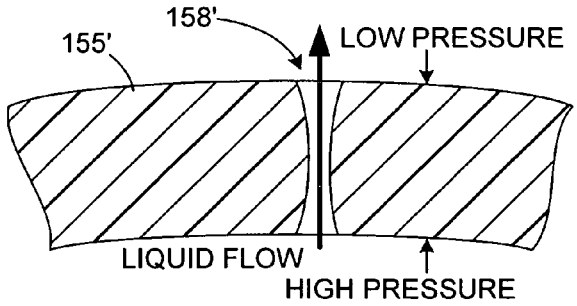
Figure 4C:
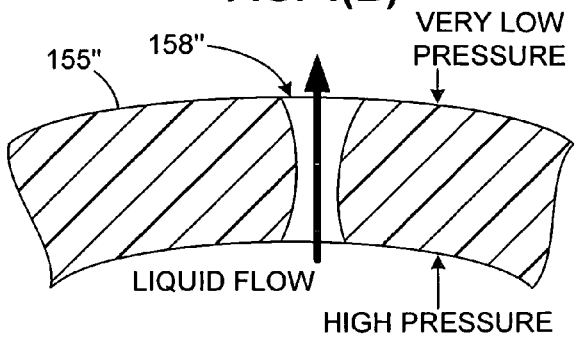

According to an aspect of the present invention, the amount of liquid flow through membrane 155 is controlled by the amount of vacuum generating by an infant/child sucking on nipple 150, thereby allowing nipple 150 to automatically adjust liquid flow to the size and/or strength of each infant/child. As indicated in FIG. 2, during use (e.g., when an infant/child sucks on nipple 150 with bottle body 110 tipped such that liquid flows into nipple chamber 157), a pressure differential is generated such that a relatively high pressure inside storage chamber 117 becomes greater than a relatively low pressure in the infant/child's mouth, thereby causing membrane 155' to stretch outward from plane P. As indicated in FIG. 4(B), the partially stretched membrane 155' causes pinholes 158' to open, thereby allowing the liquid beverage to flow through at a rate that is proportional to the amount pinhole 158' is open. That is, the amount of membrane stretching determines the size of the opened pinholes 158', which in turn determines the amount of liquid flowing through membrane 155'. For example, as indicated in FIG. 4(C), in the case where a larger infant/child creates a greater vacuum (i.e., a higher pressure differential), then membrane 155" becomes even more stretched, thereby causing pinholes 158" to open even further and allowing a greater amount of liquid flow through membrane 155". Subsequently, when the pressure differential is relieved (i.e., the child stops sucking) and atmospheric equilibrium is re-established by back venting through pinholes 158. Membrane 155 then substantially returns to its unstretched state, and pinholes 158 return to the closed state shown in FIG. 4(A). Note that because pinholes 158 do not include slits that can become weakened and/or trap deposits that can prevent slit flap closure, nipples formed in accordance with the present invention facilitates leak-free operation that is substantially more reliable than that of fixed hole or slit-based conventional nipple products.

As mentioned above, the number of pinholes 158 determines the amount of liquid flow through membrane 155 during use. Because each pinhole 158 only opens a small amount, the amount of liquid passing through each pinhole 158 during use is quite small. Accordingly, multiple pinholes 158 are arranged in a pattern that collectively facilitates desired flow conditions. In an experiment using a silicone membrane having thickness of 0.02 inches and a diameter of approximately ¾ inches, a pattern of less than ten spaced-apart pinholes was found to produce insufficient liquid flow during normal use, whereas a pattern of forty-seven pinholes was found to produce an optimal liquid flow. Of course, the number and pattern of pinholes 158 depends on a number of factors, and the pattern shown in FIG. 3 is not intended to be limiting, as further evidenced by the second embodiment disclosed below. Further, although a flat membrane 155 facilitates easier formation of pinholes 158, it may also be possible to form membrane 155 with a slightly bent or curved surface.

Figure 5:
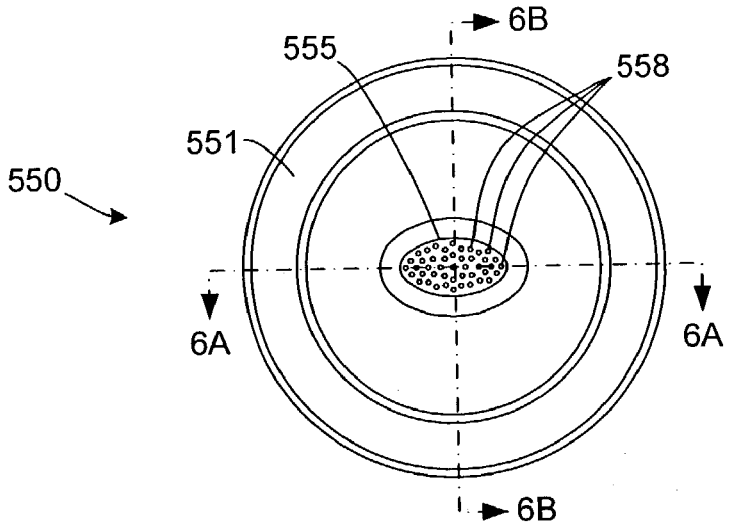
FIG. 5 is a top plan view showing a nipple according to another embodiment of the present invention.
Figure 6A:
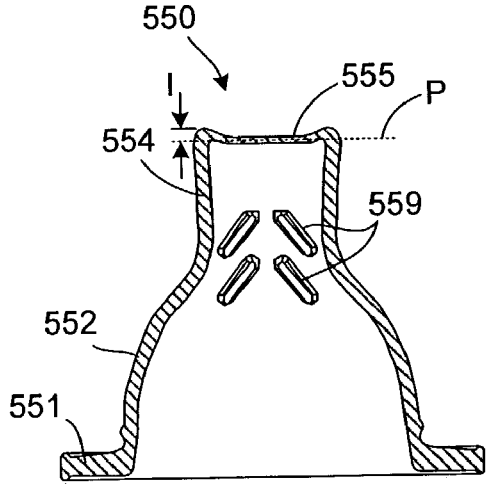
FIGS. 6(A) and 6(B) are cross-sectional side views of the nipple shown in FIG. 5 as taken along section lines 6A—6A and 6B—6B.
Figure 6B:
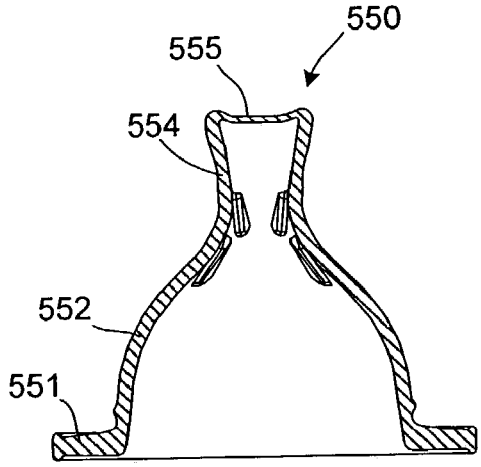

FIGS. 5, 6(A) and 6(B) show a nipple 550 according to another embodiment of the present invention. Nipple 550 includes a lower flange 551, a lower wall section 552 extending upward from flange 551, an oval neck structure 554 extending upward from lower wall section 552, and an flat oval membrane 555 formed at an upper edge of neck structure 554. The dimensions and thicknesses associated with nipple 550 are similar to those described above with reference to the first embodiment. Also, similar to the first embodiment, membrane 555 is essentially flat such that it defines a plane P1. Note that, due to the smaller size of membrane 555 (i.e., approximately one-half inch along the short axis and three-quarters of an inch along the long axis), the number of holes 558 formed therein is smaller (e.g., thirty-seven). To compensate for the smaller number of pinholes 558, the membrane thickness may be reduced (e.g., to 0.015 inches) to facilitate the same fluid flow, as compared to that of thicker membranes having a larger number of pinholes. Note also that stiffening ribs 559 may be integrally molded on the inside of neck structure 554 to resist collapse of nipple 550 during use. In one embodiment, membrane 555 is indented by an amount I (e.g., 0.015 inches) below the uppermost portion of neck structure 554.

In addition to the specific embodiment disclosed herein, other features and aspects may be added to the novel baby bottle nipple that fall within the spirit and scope of the present invention. Therefore, the invention is limited only by the following claims.

What is claimed is:

1. A baby bottle assembly comprising:

a bottle body defining a storage chamber and a threaded neck;

a removable cap mounted on the threaded neck, the cap including a top wall defining an opening; and a nipple mounted on the removable cap and including a substantially flat membrane formed from an elastomeric material, wherein the membrane defines a plurality of pinholes formed such that each pinhole is closed by the elastomeric material surrounding said each pinhole when the membrane is subjected to normal atmospheric conditions, thereby preventing passage of a liquid from the storage chamber through the membrane, and each pinhole is opened when the membrane is subjected to an applied pressure differential that causes the membrane to stretch, thereby facilitating liquid flow from the storage chamber.

2. The baby bottle assembly according to claim 1, wherein the membrane has a circular outer perimeter having a diameter of 0.25 to 1.0 inches and a thickness of 0.01 to 0.1 inches, and wherein the plurality of pinholes comprises a number greater than ten.

3. The baby bottle assembly according to claim 2, wherein the number of pinholes is greater than thirty.

4. The baby bottle assembly according to claim 1, wherein the nipple further comprises:

a disk shaped flange;

a lower conical wall section extending upward from the flange;

a neck region located at an upper end of the lower conical wall section;

an upper conical wall section extending upward from the neck region, wherein the substantially flat membrane is formed on an upper portion of the upper conical wall section.

5. The baby bottle assembly according to claim 4, wherein the membrane has thickness of 0.01 to 0.1 inches, and wherein the plurality of pinholes comprises a number greater than ten.

6. The baby bottle assembly according to claim 5, wherein a thickness of the flange is 0.06 to 0.1 inches, wherein a thickness of the lower conical wall section is 0.04 to 0.08 inches, and wherein a thickness of the upper conical wall section is 0.04 to 0.08 inches.

7. The baby bottle assembly according to claim 4, wherein the lower conical wall section defines a first diameter, the neck region defines a second diameter, and the membrane defines a third diameter, wherein the second diameter of the neck region is less than the first diameter of the lower conical wall section and the third diameter of the membrane.

8. The baby bottle assembly according to claim 1, wherein the membrane is circular.

9. The baby bottle assembly according to claim 1, wherein the membrane is oval.

10. The baby bottle assembly according to claim 1, wherein the nipple comprises silicone.

11. The baby bottle assembly according to claim 1, wherein the nipple comprises thermoplastic elastomer.

12. The baby bottle assembly according to claim 1, wherein the nipple comprises soft rubber.

13. A nipple for a baby bottle assembly, the nipple comprising:

a wall section defining an interior chamber, the wall section having a first thickness; and a disk-shaped membrane connected to the wall section such that the membrane covers a portion of the interior chamber, wherein the membrane has a second thickness that is smaller than the first thickness of the wall section, and wherein the membrane defines a plurality of pinholes formed such that each pinhole is closed by elastomeric material surrounding said each pinhole when the membrane is subjected to normal atmospheric conditions, thereby preventing passage of a liquid through the membrane, and each pinhole is opened when the membrane is subjected to an applied pressure differential that causes the membrane to stretch, thereby facilitating liquid flow through the membrane.

14. The nipple according to claim 13, wherein the membrane has a circular outer perimeter having a diameter of 0.25 to 1.0 inches and a thickness of 0.01 to 0.1 inches, and wherein the plurality of pinholes comprises a number greater than ten.

15. The nipple according to claim 14, wherein the number of pinholes is greater than thirty.

16. The nipple according to claim 13, wherein the membrane is circular.

17. The nipple according to claim 13, wherein the membrane is oval.

18. The nipple according to claim 13, wherein the nipple comprises at least one of silicone, thermoplastic elastomer, and soft rubber.

* * * * *